US006572420B2

(12) United States Patent
Lawrence

(10) Patent No.: US 6,572,420 B2
(45) Date of Patent: Jun. 3, 2003

(54) ELECTRICAL CONTACTS WITH SPECIALIZED SURFACE TREATMENTS

(75) Inventor: Wallace C. Lawrence, Durham, NC (US)

(73) Assignee: International Business Machines Corporation, Armonk, NY (US)

( * ) Notice: Subject to any disclaimer, the term of this patent is extended or adjusted under 35 U.S.C. 154(b) by 1 day.

(21) Appl. No.: 09/737,932

(22) Filed: Dec. 18, 2000

(65) Prior Publication Data

US 2002/0077004 A1 Jun. 20, 2002

(51) Int. Cl.[7] ..... H01R 13/02
(52) U.S. Cl. ..... 439/887
(58) Field of Search ..... 439/887, 931

(56) References Cited

U.S. PATENT DOCUMENTS 1,555,803 A * 9/1925 Huber
2,106,904 A * 2/1938 Wilhelm

OTHER PUBLICATIONS

Military Specification "Lubricants, Water Displacing, Synthetic," MIL–L–87177A, Amendment 1, Feb. 28, 1991.
Military Specification, "Corrosion Preventive Compounds, Water Displacing, Ultra–Thin Film," MIL–C–81309E, Mar. 31, 1993 Superseding MIL–C–81309D, Jul. 26, 1982.

* cited by examiner

*Primary Examiner*—Khiem Nguyen
(74) *Attorney, Agent, or Firm*—Mark E. McBurney; Bracewell & Patterson, L.L.P.

(57) ABSTRACT

One embodiment of an electrical contact has a copper alloy substrate and a hard underlayer plating such as nickel. The underlayer is coated with a thin, liquid barrier film coating. The substance that forms the coating is one of the proprietary materials that are described in military specifications MIL-C-81309E, and MIL-L-87177A, Amendment 1. The military specifications generally describe classes of ultra-thin film, water-displacing, corrosion preventive compounds that may be applied by dipping, brushing, or from gas-pressurized containers. The mating surfaces of both mating contacts (i.e., male and female) are provided with the coating. The coatings provide excellent corrosion protection for both contacts despite physical contact therebetween.

2 Claims, 2 Drawing Sheets

ELECTRICAL CONTACTS WITH SPECIALIZED SURFACE TREATMENTS

BACKGROUND OF THE INVENTION

1. Technical Field

The present invention relates in general to improved electrical connectors, and in particular to an improved surface treatment for electrical contacts in high reliability signal applications.

2. Description of the Related Art

Separable electronic connectors function as bridges or electromechanical interfaces for transferring low level, electronic signals from one electrical circuit to another. It is desirable to have minimal alteration of the amplitude or shape of the signals. To insure reliable operation, the mating surfaces of the connectors must have very low electrical resistances and be held tightly together. These objectives can be achieved with a physical design that incorporates a backbone made of spring metal containing a sandwich of metals at the mating area between the contacts.

The metallurgical properties of the mating surfaces at the area of contact is critical to long reliable performance of a connector. Good performance is typically achieved with a combination of coatings, platings, or claddings such as electroplated metals, each possessing unique properties. As shown in FIG. 1, the surface of a contact 11 typically has a substrate or base material 13 formed from less expensive spring materials like copper alloys (e.g., brasses, phosphor bronze, and beryllium copper), which exhibit good electrical properties. The first layer in the electroplating is usually composed of a hard underplate 15 such as nickel for good wear properties. Underplate 15 is approximately 50 microinches thick. The next layer is typically a soft noble metal overplate 17 such as gold, palladium, and palladium alloys (e.g., palladium/nickel). Noble metals are extensively used as the overplate. Overplate 17 is approximately 30 microinches thick.

Noble metals have excellent electrical conductivity with good chemical and environmental resistance at the point of contact. Since the most common failure mechanism for connectors is chemical attack with high resistance corrosion products at the contact interface, corrosion resistance to environmental conditions is critical to a long reliable life. Noble metals exhibit excellent corrosion resistance and, when plated in sufficient thicknesses, provide excellent protection. However, as thinner overplatings are becoming more popular, discontinuities such as breaks, pores, pits, etc., appear in the protective surface. Corrosion can penetrate through such discontinuities to the underlying base material and cause loss of performance. Moreover, noble metals are relatively expensive and they are time consuming to apply to the electrical contacting surfaces.

During manufacturing, the spring member or connector contacts are typically formed into long lines of breakapart individual contacts, much like a string of paper dolls with hands interconnected. The mating spots on each connector are located so that they may be dipped into electroplating baths and have the under and over plating applied in a continuous process. Overall connector cost is greatly influenced by the thickness and composition of each plating. Plating thickness is directly proportional to process time in a plating bath and affects throughput. Since noble metals or alloys are relatively expensive, thinner noble metal thicknesses reduce the cost of the connectors. The complete elimination of a plating layer would be a significant cost reduction. Although thinner noble metal platings are possible and would reduce connector costs, the connectors would have less corrosion protection.

Consequently, the connectors also would have less reliable and shorter product lifespans.

Many approaches have been attempted to improve the reliability of connectors in high reliability applications. In particular, attempts have been made to overcome reduced reliability with less expensive or thin platings. Coating connector contacts with oils and greases reduces mating friction, improves wear life, and provides some environmental protection. Very specialized oils have been developed for the connector industry, both for signal and power applications. Although wear at the contact mating surfaces can be improved with the application of lubricants, environmental protections is only moderate at best. Thus, an alternative solution for high reliability electrical contact surfaces that provides excellent corrosion resistance at a lower cost would be highly desirable.

SUMMARY OF THE INVENTION

One embodiment of an electrical contact has a copper alloy substrate and a hard underlayer plating such as nickel. The underlayer is coated with a thin, liquid barrier film coating. The substance that forms the coating is one of the proprietary materials that are described in military specifications MIL-C-81309E, and MIL-L-87177A, Amendment 1. The military specifications generally describe classes of ultra-thin film, water-displacing, corrosion preventive compounds that may be applied by dipping, brushing, or from gas-pressurized containers. The mating surfaces of both mating contacts (i.e., male and female) are provided with the coating. The coatings provide excellent corrosion protection for both contacts despite physical contact therebetween.

The foregoing and other objects and advantages of the present invention will be apparent to those skilled in the art, in view of the following detailed description of the preferred embodiment of the present invention, taken in conjunction with the appended claims and the accompanying drawings.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

Figure 1:
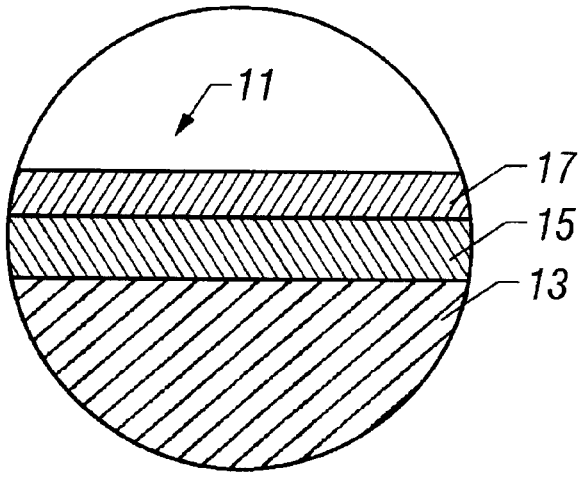
FIG. 1 (Prior Art)
FIG. 1 is a magnified sectional side view of a prior art connector contact showing the base material and layers of plating.
Figure 2:
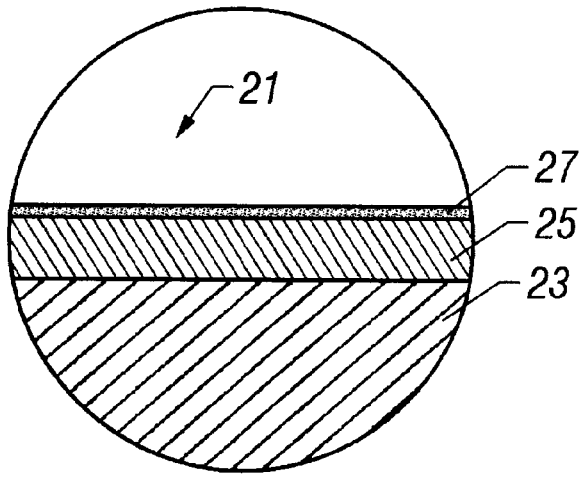
FIG. 2 is a magnified sectional side view of one embodiment of a connector contact showing the base material and layers of plating, and is constructed in accordance with the present invention.

Referring to FIG. 2, the outer mating surface of a contact 21 constructed in accordance with the invention is shown.

Contact 21 has a base material or substrate 23 that is preferably formed from a relatively inexpensive spring material such as a copper alloy (e.g., brass, phosphor bronze, and beryllium copper). In the embodiment shown, substrate 23 has an optional underplate or underlayer 25 electroplated to its outer surface. In the preferred embodiment, underlayer 25 is formed from a substance that is harder than substrate 23, such as nickel, for good wear properties. Underlayer 25 is approximately 50 microinches thick. In an alternate version, a thin layer of noble metal may be applied on top of underlayer 25, but it is not necessary.

The critical element of the invention is the outermost layer that is applied to the outer mating surface of contact 21 (i.e., underlayer 25 in the embodiment shown). As shown in FIG. 2, contact 21 has a very thin, liquid barrier film coating 27. One of two special coating materials is used to form coating 27. The coating materials were developed as thin film lubricants and corrosion barriers for metals in marine environments. However, these coating materials have also proven to have significant utility as corrosion barriers for contacts in electrical connectors. The chemical compositions of these coating materials are proprietary. The active ingredients of the coating materials are carried by solvents that flash off when applied leaving a thin film. Coating 27 may be applied in a manufacturing process as part of the underlayer 25 operation, in a spray or dip of individual part process, or in any other manner as appropriate for a specific part. Although the final thickness of coating 27 is not critical, complete coverage is required.

The substance that forms coating 27 is one of two proprietary materials that are described in military specifications MIL-C-81309E, and MIL-L-87177A, Amendment 1, each of which is incorporated herein by reference.

Military specification MIL-C-81309E generally describes two types and two classes of ultra-thin film, water-displacing, corrosion preventive compounds that may be applied by dipping, brushing, or from non-fully halogenated chlorofluorocarbon gas-pressurized containers. The composition of the preferred Type II, Class 2, compound for military specification MIL-C-81309E is propriety information held by the manufacturer ZIP-CHEM® Products, a division of Andpak, Inc., and marketed under the product name D-5026 NS.

Military specification MIL-L-87177A, Amendment 1 generally describes a synthetic lubricant, water-displacing, corrosion preventive compound that may be applied from gas pressurized containers, or by dipping or brushing. The composition of the preferred Type I, grade B, compound is propriety information held by the manufacturer Lecktro-Tech, Inc., and marketed under the product name LEKTRO-TECH SUPER CORR-B. In both cases, the applied compound of coating 27 forms a film that is uniform and does not froth, bubble, or excessively run off. No significant changes in electrical properties are affected by the presence of coating 27.

Figure 3:
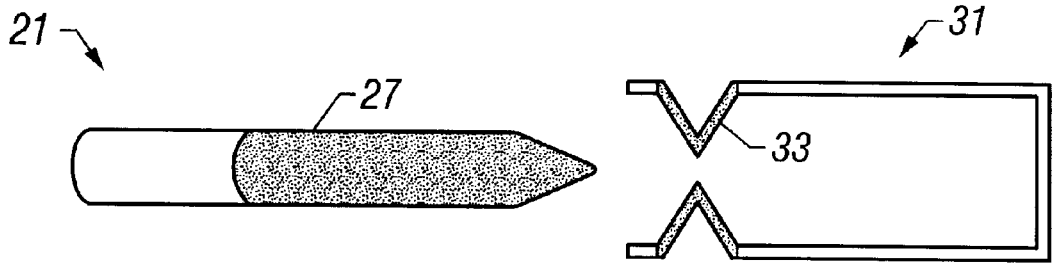
FIG. 3 is a side view of pin and socket contacts constructed in accordance with the invention and shown prior to mating.

In operation (FIG. 3), an electrical connector having one or more contacts such as contact 21 are provided for interconnection with a receptacle such as spring member socket contact 31. Contact 21 has barrier coating 27 on all of its mating surfaces or critical contact areas that require protective electroplating, as described above. Socket contact 31 also is provided with a barrier coating 33, which is identical to coating 27.

Figure 4:
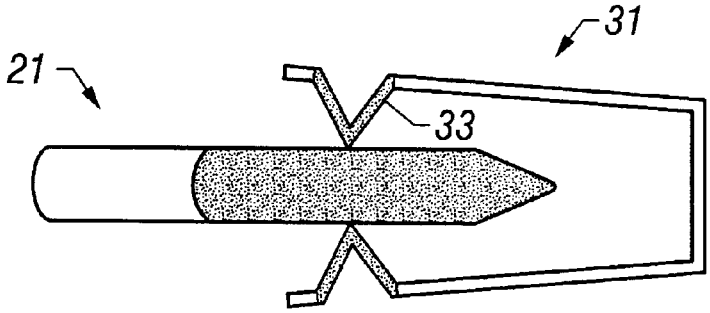
FIG. 4 is a side view of the pin and socket contacts of FIG. 3 shown mated.

Coating 33 is similarly provided on all mating surfaces of socket contact 31. As shown in FIG. 4, barrier coatings 27, 33 provide excellent corrosion protection for both contact 21 and socket contact 31 despite physical contact therebetween.

The present invention has several advantages. When applied to the contacts of electrical connectors, the barrier coating materials exhibit dramatic improvements in reliability and longevity even on contacts plated with non-corrosion resistant underplates. The barrier coatings allow expensive noble metal platings to be significantly reduced or replaced with no loss in performance. The present invention is particularly well suited for reliable and long life applications in connectors and switches, such as low level signal applications. The classes of film-forming, low viscosity materials described herein provide excellent corrosion protection for metallic elements in hostile environments while maintaining the desirable low electrical interface resistance of mating separable contacts. In addition, these materials have low fugacity over a wide temperature range and are self-healing when penetrated. An added benefit is the ease of application via various techniques.

While the invention has been shown or described in only some of its forms, it should be apparent to those skilled in the art that it is not so limited, but is susceptible to various changes without departing from the scope of the invention.

What is claimed is:

1. An electrical contact for an electrical connector, comprising:

a substrate having mating surfaces that are adapted to engage a mating electrical contact; and a barrier coating formed on the substrate for providing corrosion protection, wherein the barrier coating is selected from the group consisting of the substances defined in military specifications MIL-C-81309E, and MIL-L-87177A, Amendment 1, an underlayer formed on the substrate between the substrate and the barrier coating: and a layer of noble metal formed on the underlayer between the underlayer and the barrier coating.

2. A mating pair of electrical contacts for electrical connectors, comprising:

a first contact having a first substrate with first mating surfaces;

a second contact having a second substrate with second mating surfaces for interconnecting with the first mating surfaces; and a barrier coating formed on each of the first and second mating surfaces for providing corrosion protection, wherein the barrier coating is selected from the group consisting of the substances defined in military specifications MIL-C-81309E, and MIL-L-87177A, Amendment 1;

an underlayer formed on each of the first and second substrates between the substrates and their respective barrier coatings; and a layer of noble metal formed on each of the underlayer between the uderlayers and their respective barrier coatings.

* * * * *